US011686216B2

(12) United States Patent
Ovaere et al.

(10) Patent No.: US 11,686,216 B2
(45) Date of Patent: Jun. 27, 2023

(54) TURBOMACHINE OUTPUT BEARING SUPPORT

(71) Applicant: SAFRAN AIRCRAFT ENGINES, Paris (FR)

(72) Inventors: Nicolas Ovaere, Moissy-Cramayel (FR); Fabien Stéphane Garnier, Moissy-Cramayel (FR); Arnaud Lasantha Genilier, Moissy-Cramayel (FR); Pierre Jean-Baptiste Metge, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/597,065

(22) PCT Filed: Jun. 16, 2020

(86) PCT No.: PCT/FR2020/051040
§ 371 (c)(1),
(2) Date: Dec. 23, 2021

(87) PCT Pub. No.: WO2020/260796
PCT Pub. Date: Dec. 30, 2020

(65) Prior Publication Data

US 2022/0235672 A1 Jul. 28, 2022

(30) Foreign Application Priority Data

Jun. 26, 2019 (FR) ..... 1906933

(51) Int. Cl.
*F01D 25/16* (2006.01)
*F01D 25/18* (2006.01)
*F01D 25/24* (2006.01)

(52) U.S. Cl.
CPC ..... *F01D 25/162* (2013.01); *F01D 25/18* (2013.01); *F01D 25/24* (2013.01);
(Continued)

(58) Field of Classification Search
CPC ..... F01D 25/18; F01D 25/24; F01D 25/243; F01D 25/162; F05D 2220/32; F05D 2240/50; F05D 2260/98
See application file for complete search history.

(56) References Cited

U.S. PATENT DOCUMENTS 4,502,274 A * 3/1985 Girault ..... F16C 33/6662 416/174
9,551,236 B2 * 1/2017 Durand ..... F01D 25/16
(Continued)

FOREIGN PATENT DOCUMENTS

FR 2903151 A1 1/2008
FR 2997444 A1 5/2014
(Continued)

OTHER PUBLICATIONS

French Search Report issued in French Application FR 1906933 dated Feb. 5, 2020 (2 pages).
(Continued)

*Primary Examiner* — Igor Kershteyn
(74) *Attorney, Agent, or Firm* — Bookoff McAndrews, PLLC

(57) ABSTRACT

Turbomachine output bearing support extending according to an axial direction, said support being formed by one and the same piece and comprising an annular inner wall having an inner side and an outer side, an annular outer wall and a twist support.

8 Claims, 5 Drawing Sheets

(52) U.S. Cl.
CPC ..... *F05D 2220/32* (2013.01); *F05D 2230/31* (2013.01); *F05D 2240/50* (2013.01); *F05D 2260/98* (2013.01)

(56) References Cited

U.S. PATENT DOCUMENTS

| | | | | |
|---|---|---|---|---|
| 9,970,320 | B2 * | 5/2018 | De Sousa | F01D 25/243 |
| 10,167,731 | B2 * | 1/2019 | Curlier | F01D 25/16 |
| 2009/0133581 | A1 * | 5/2009 | Fang | F16C 33/6685 96/216 |
| 2013/0183142 | A1 | 7/2013 | Durand et al. | |
| 2016/0115817 | A1 | 4/2016 | Curlier et al. | |
| 2022/0195944 | A1 * | 6/2022 | Friedberg | F02C 7/28 |

FOREIGN PATENT DOCUMENTS

| | | | |
|---|---|---|---|
| FR | 3013380 | A1 | 5/2015 |
| WO | 2019180375 | A1 | 9/2019 |

OTHER PUBLICATIONS

International Search Report issued in International Application PCT/FR2020/051040 dated Sep. 4, 2020 with English Translation (5 pages).

* cited by examiner

[Fig. 1]
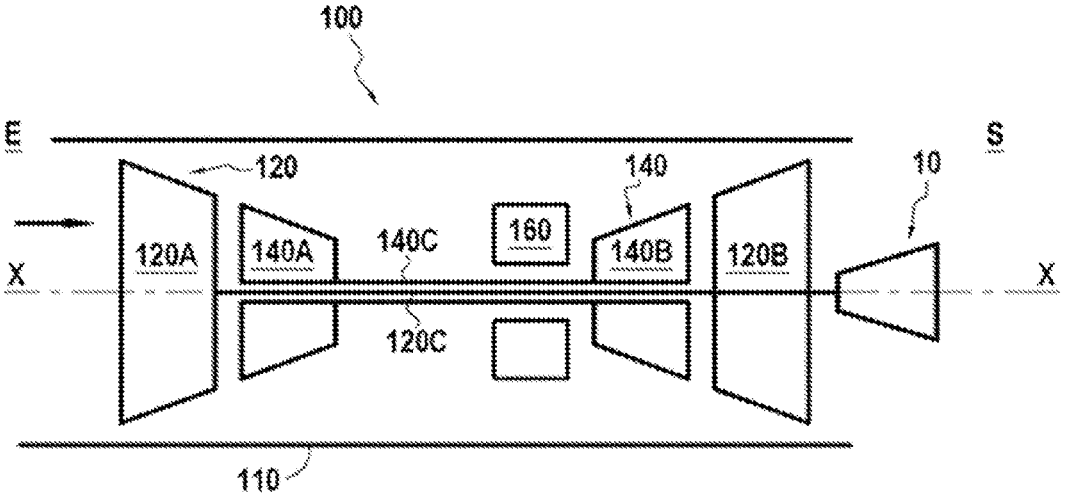

[Fig. 2]
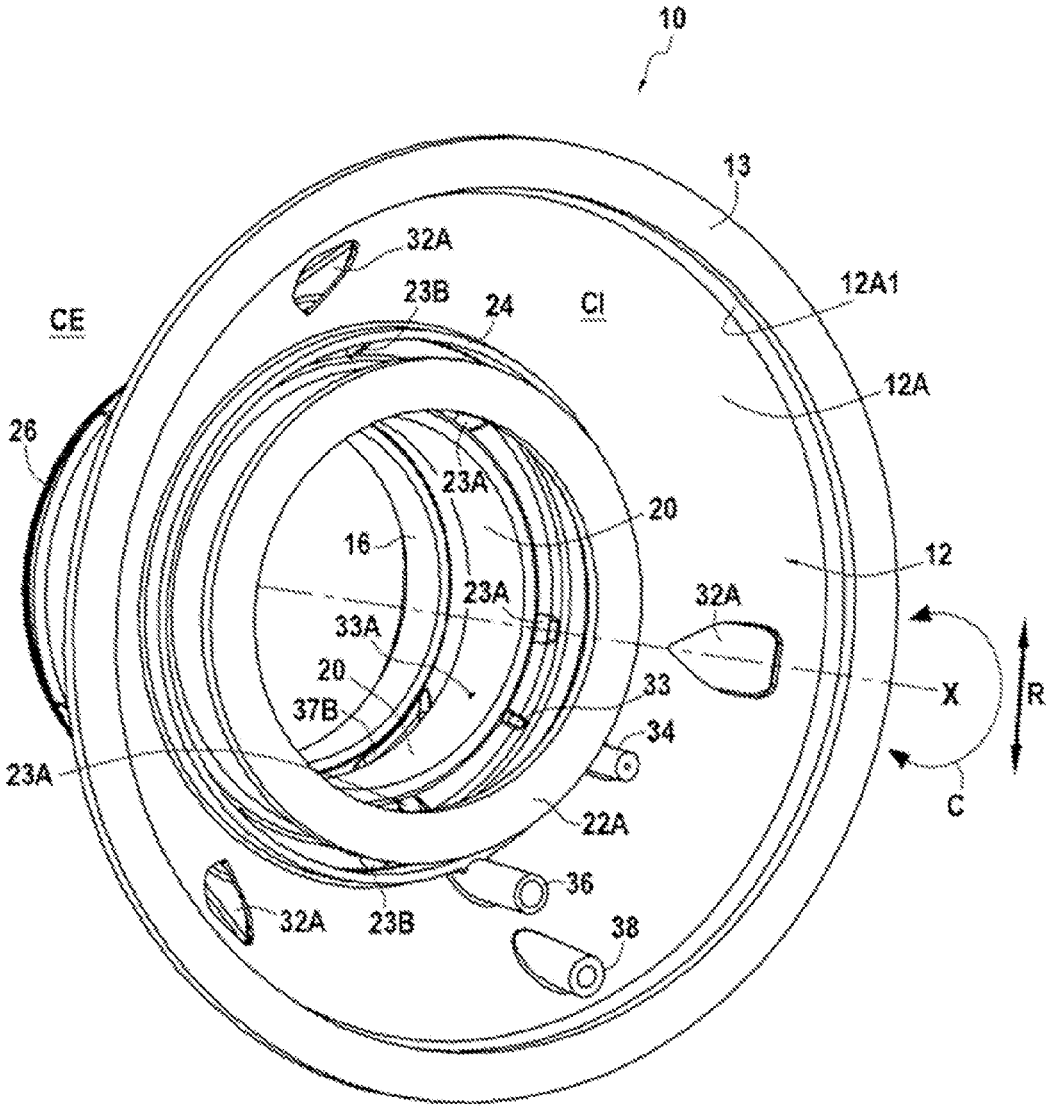

[Fig. 3]
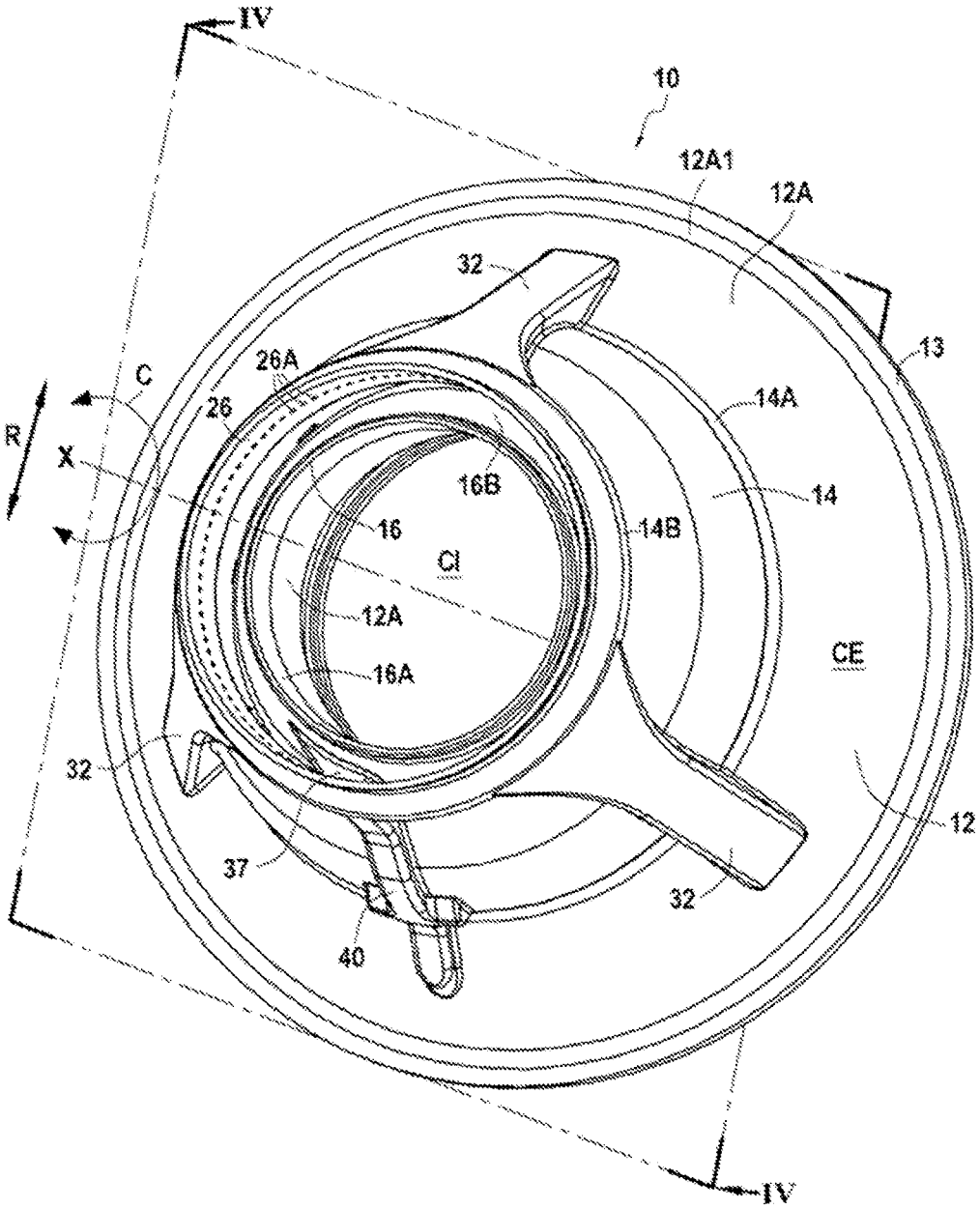

[Fig. 4]
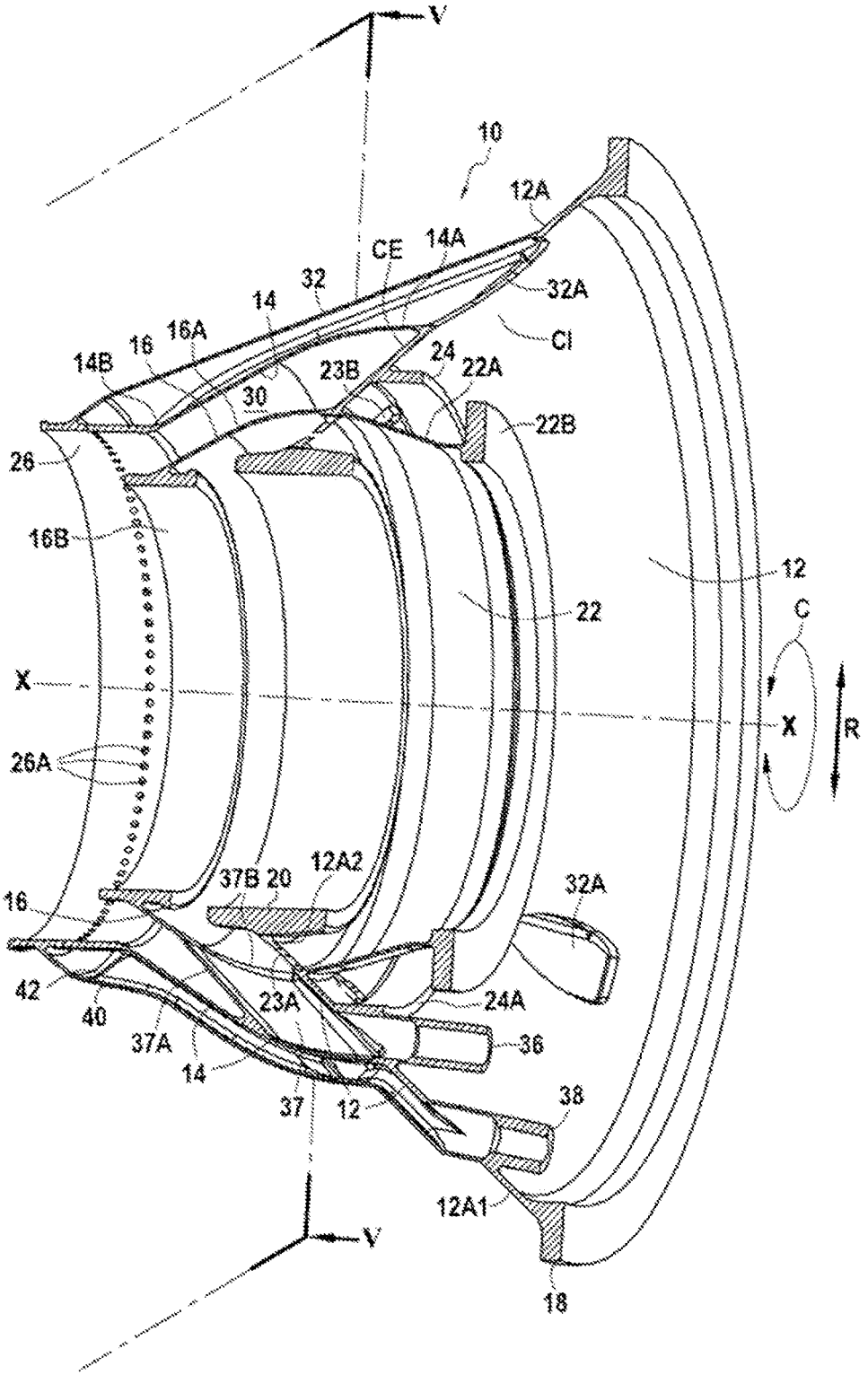

[Fig. 5]
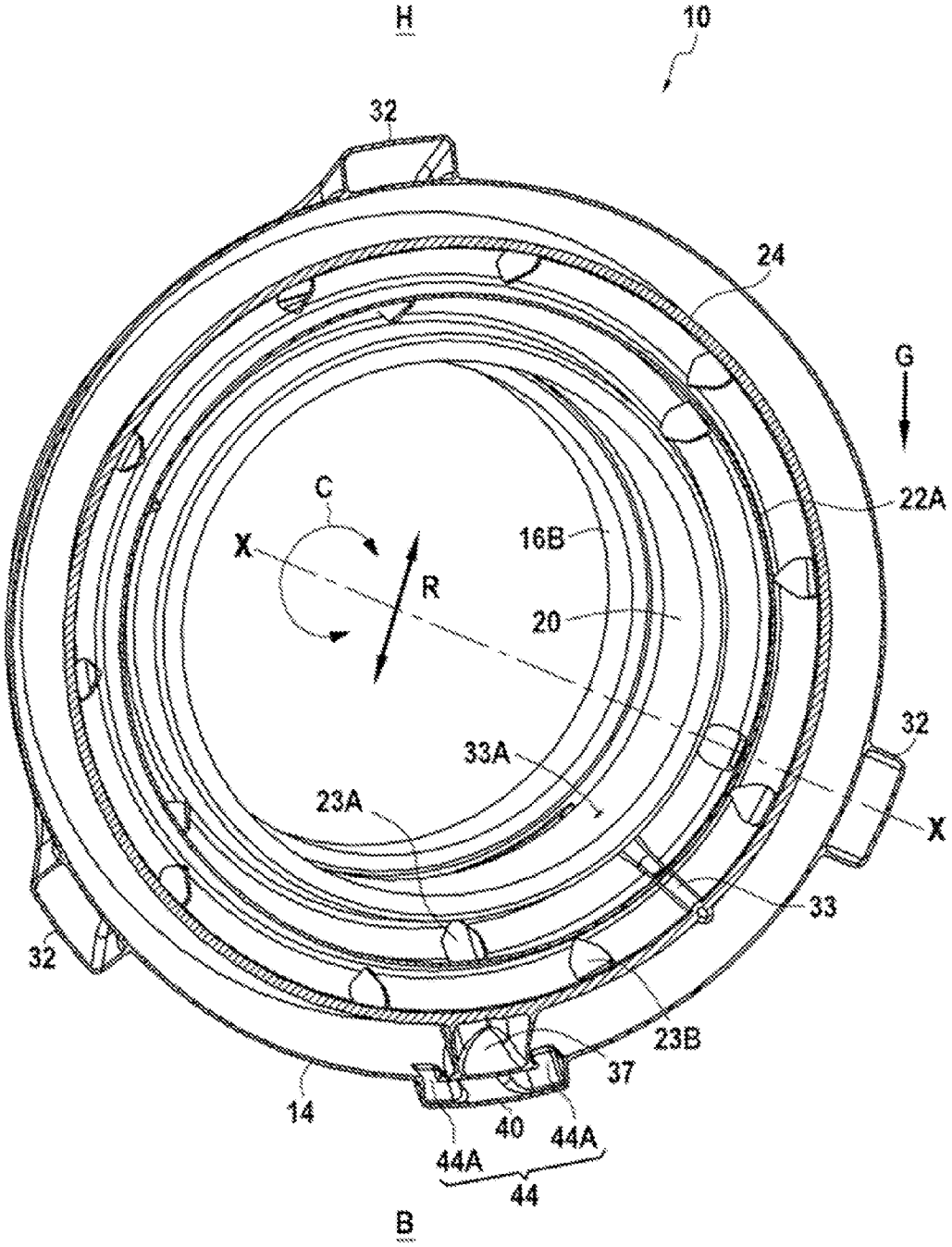

TURBOMACHINE OUTPUT BEARING SUPPORT

CROSS-REFERENCE TO RELATED APPLICATION(S)

This patent application is the U.S. National Stage entry under 35 U.S.C. § 371 of International Patent Application No. PCT/FR2020/051040, filed on Jun. 16, 2020, which claims the benefit of priority to French Patent Application No. 1906933, filed on Jun. 26, 2019.

TECHNICAL FIELD

The present presentation relates to a turbomachine output bearing support.

The term "turbomachine" designates all gas turbine units producing drive power, distinguished examples of which especially are turbojets providing thrust necessary for propulsion by reaction to the high-speed ejection of hot gases, and turboshafts in which the drive power is provided by the rotation of an engine shaft. For example, turboshafts are used as engines for helicopters, ships, trains, or also as industrial engines. Turboprops (turboshaft driving a helix) are also turboshafts used as aircraft engines.

The turbomachine output bearing is the latest bearing of the turbomachine considered in terms of gas flow inside the turbomachine, from upstream to downstream, carrying one or more rotor shafts of the turbomachine.

PRIOR ART

Known turbomachine bearing output supports are generally complex items comprising several parts machined separately and then joined together, especially by bolting. Such a manufacturing process is complex and costly. Also, assembly by bolting makes these known bearing supports relatively heavy pieces. There is therefore a need in this sense.

DISCLOSURE OF THE INVENTION

An embodiment relates to a turbomachine output bearing support extending according to an axial direction, said support being formed by one and the same piece and comprising an inner wall having an inner side and an outer side, an outer wall and a twist support.

Hereinbelow and unless expressed otherwise, "support" means "turbomachine output bearing support". A twist is an element also known by the skilled person, which prevents oil leaks from a bearing.

The axial direction is defined by a geometric axis of the support, for example an axis of symmetry of revolution. A radial direction is a direction perpendicular to the axial direction. The azimuthal or circumferential direction corresponds to the direction describing a ring around the axial direction. The three axial, radial and azimuthal directions correspond respectively to the directions defined by the side, the radius and the angle in a cylindrical coordinates system. Also, unless expressed otherwise, the adjectives "internal/inner" and "external/outer" are used in reference to a radial direction such that the internal part (i.e. radially internal) of an element is closer to the axis defining the axial direction than the external part (i.e. radially external) of the same element.

It is understood that the outer and inner walls are annular and that the outer wall is arranged to the outer side of the inner wall.

Forming the support by one and the same piece, for example by additive manufacturing, can eliminate assembly elements of supports known from the prior art. Also, forming the support by one and the same piece can do away with some parts of supports known from the prior art, and can integrate them fully or partly with the inner wall and/or the outer wall and/or the twist support. This also avoids some complex machining necessary in supports known from the prior art.

In some embodiments, the inner wall comprises a first section having a first substantially frustoconical form (i.e. annular divergent form) extending according to the axial direction and having the inner side and the outer side, the first section having a first axial end provided with a first attachment flange and a second axial end, opposite according to the axial direction to the first axial end, provided with a bearing support section, the first section carrying on the inner side an inner section forming a second attachment flange.

"Substantially frustoconical" or "divergent annular form" means a regular frustoconical form (i.e. of a constant angle relative to the axial direction), an irregular frustoconical form (i.e. of a constant angle per section along the axial direction, different from one section to the other), a concave curved form (for example in the form of a bell) or convex (for example in the form of a trumpet bell), a combination of the above forms, or more generally any annular geometry connecting a first axial end having a first diameter to a second axial end having a second diameter larger than the first diameter.

In some embodiments, the twist support is carried by the inner wall on the outer side.

In other terms, the twist support extends from the external side of the inner wall. For example, the twist support is arranged between the inner wall and the outer wall.

In some embodiments, the outer wall has a second substantially frustoconical form (i.e. divergent annular form) extending according to the axial direction and having a third axial end attached to the inner wall on the outer side of the inner wall, and a fourth axial end, opposite the second axial end according to the axial direction, forming a collector ring.

In other terms, the outer wall extends from the external side of the inner wall. The inner wall and the outer wall are coaxial. The twist support can be coaxial with the inner wall and the outer wall.

The collector ring can be an annular section configured to collect/discharge pressurised fluid, for example gas, from the internal side of the outer wall. For example, a cavity is formed between the external wall and the twist support, the collector ring being configured to discharge pressurised fluid in this cavity. For example, the collector ring can form an annular chamber having one or more radial openings in fluidic communication with the interior of the support.

In some embodiments, the turbomachine output bearing support comprises at least one air exhaust duct extending from the external side of the outer wall and fluidically connecting the inner side of the inner wall and the collector ring.

The air exhaust duct can discharge gases collected in the collector ring to the inner side of the inner wall. For example, the exhaust duct can also extend over the outer side of the inner wall. For example, the outer wall and/or the inner wall form at least one section of the walls forming the air exhaust duct.

Compared to the supports of the prior art, such a duct especially dispenses with much bulkier and heavier additional walls and therefore significantly reduces the mass of the support.

In some embodiments, the turbomachine output bearing support comprises three air exhaust ducts uniformly distributed around the axial direction.

Such a configuration ensures uniform air discharge and uniformly distributes the mass over the circumference of the support.

In some embodiments, the at least one air exhaust duct has an air outlet opening arranged in the inner wall.

In some embodiments, the turbomachine output bearing support comprises an oil drainage duct.

Such a drainage duct collects the lubricating oil of the bearing which escapes from the oil circuit of the bearing. Such a drainage duct is distinct from an oil recovery duct of the oil circuit of the bearing. For example, the oil drainage duct can be configured to drain oil by gravity. For example, the bearing support can have a top and a base, the drainage duct being arranged to the side of the base of the support. For example, the drainage duct can define the low side of the support.

In some embodiments, the oil drainage duct extends on the outer side of the outer wall and has a first intake arranged in the collector ring, a second intake arranged in the outer wall and opening in a space formed between the twist support and the outer wall, and an output terminating to the inner side of the inner wall.

For example, the drainage duct can also extend over the outer side of the inner wall. For example, the outer wall and/or the inner wall form at least one section of the walls forming the drainage duct. Compared to supports of the prior art, such a duct especially dispenses with additional heavy and bulky walls and therefore significantly reduces the mass of the support.

An embodiment also relates to a manufacturing process of a turbomachine output bearing support according to any one of the embodiments described in the present presentation, comprising at least one additive manufacturing step.

As a reminder, additive manufacturing is a manufacturing process by addition of material, by stacking of successive layers. For example, the successive layers are formed by powder which is sintered selectively by laser.

Such a manufacturing process is particularly well-adapted to make complex pieces such as the turbomachine output bearing support forming the subject matter of the present presentation. This especially avoids some complex machining steps which are necessary in supports of the prior art.

BRIEF DESCRIPTION OF THE DRAWINGS

The aim of the present presentation and its advantages will become clearer from the following detailed description given hereinbelow of different embodiments given by way of non-limiting examples. This description makes reference to the pages of attached figures, in which:

FIG. 1 illustrates a turbomachine,

FIG. 2 illustrates the output bearing support of the turbomachine of FIG. 1, in perspective, FIG. 3 illustrates the output bearing support of the turbomachine of FIG. 1, according to another view in perspective, FIG. 4 illustrates the output bearing support of the turbomachine seen according to the sectional plane IV of FIG. 3, and FIG. 5 illustrates the output bearing support of the turbomachine seen according to the plane V of FIG. 4.

DESCRIPTION OF EMBODIMENTS

FIG. 1 illustrates a schematic view of a turbomachine 100, in this example a twin-body turbojet, comprising a turbomachine output bearing support 10. In this example, the turbomachine 100 comprises a casing 110 housing a low-pressure body 120, a high-pressure body 140 and a combustion chamber 160. The low-pressure body 120 comprises a low-pressure compressor 120A and a low-pressure turbine 120B coupled in rotation by a shaft 120C. The high-pressure body 140 comprises a high-pressure compressor 140A and a high-pressure turbine 140B coupled in rotation by a shaft 140C. The shaft 120C is coaxial to the shaft 140C, and extends through the shaft 140C. The shafts 120C and 140C are mobile in rotation around the axis X of the turbomachine.

The turbomachine output bearing support 10 extends according to the axial direction X, and is coaxial with the shafts 120C and 140C. In this example, the support 10 supports the bearing of the shaft 120C arranged to the side of the output S of the turbomachine 100, the gas flowing inside the turbomachine 100 from upstream to downstream from the intake E to the output S according to the arrow shown in bold.

The turbomachine output bearing support 10 is described in more detail in reference to FIGS. 2, 3, 4 and 5. It is noted that only the support 10 is shown in these figures. In particular, the bearing and the twist which are carried by this support 10 are not shown. The support 10 extends according to the axial direction X, according to a radial direction R and a circumferential direction C.

The support 10 is formed by one and the same piece by additive manufacturing and comprises an inner wall 12, an outer wall 14 and a twist support 16. The inner wall 12 has an inner side CI and an outer side CE The inner wall 12 comprises a first section 12A having a first substantially frustoconical form extending according to the axial direction X and having the inner side CI and the outer side CE, the first section 12A having a first axial end 12A1 provided with a first attachment flange 18 and a second axial end 12A2, opposite according to the axial direction X to the first axial end 12A1, provided with a bearing support section 20, the first section 12A carrying on the inner side CI an inner section 22 forming a second attachment flange. In this example, the inner section 22 comprises a sleeve 22A extending according to the axial direction X and attached to the first section 12A, on the inner side Cl. The sleeve 22A carries a section forming an attachment flange 22B. In this example, the diameter of the second flange 22 is less than the diameter of the first flange 18. The second flange 22 is arranged retracted according to the axial direction X relative to the first flange 18, inside the inner wall 12. In this example, the sleeve 22A has a third substantially frustoconical form of axis X (the second substantially frustoconical form being formed by the second wall described in more detail hereinbelow) and opposite inclination relative to the inclination of the first section 12A.

In this example, the first section 12A has on the inner side CI a cylindrical section 24 of axis X and section transverse to the circular axial direction. The cylindrical section 24 is arranged radially between the inner section 22 and the first flange 18. The distal end of the section 24 is arranged retracted according to the axial direction X of the section forming the flange 22B, inside the inner wall 12. The section 24 is configured to attach an oil intake lid, for example by sintering. A sealing joint can also be arranged between said lid and the section 24.

It is evident that the first section 12A has through holes 23A arranged radially between the bearing support section 20 and the inner section 22 and through holes 23B arranged radially between the inner section 22 and the cylindrical section 24. These holes 23A and 23B are uniformly distributed according to the circumferential direction C. These holes 23A and 23B form passages for flow of oil of the bearing not shown and carried by the bearing support 10.

The twist support 16 is carried by the inner wall 12, on the outer side CE. In this example, the twist support 16 has a sleeve 16A extending according to the axial direction X and attached to the first section 12A, on the outer side CE. The sleeve 16A carries a section forming a twist support 16B. In this example, the diameter of the section of twist support 16B is less than the diameter of the bearing support section 20. The section of twist support 16B is arranged beyond the bearing support section 20 according to the axial direction X, on the external side of the inner wall 12. In this example, the sleeve 16A has a fourth substantially frustoconical form of axis X inclined to the same side relative to the axial direction as the first section 12A.

The outer wall 14 has a second substantially frustoconical form extending according to the axial direction X and having a third axial end 14A attached to the inner wall 12 on the outer side CE of the inner wall 12, and a fourth axial end 14B, opposite the second axial end 14A according to the axial direction X, forming a collector ring 26. The substantially frustoconical form of the outer wall 14 is inclined to the same side relative to the axial direction X as the first section 12A.

In this example, the first, second, third and fourth substantially frustoconical forms are all different. According to a variant, some of these forms, or even all these forms, could be identical (for example all regular frustoconical, but of different sizes).

In this example, the collector ring 26 is an annular section forming an annular chamber having several radial openings 26A oriented to the interior of the bearing support 10 and uniformly distributed according to the circumferential direction C. In this example, a cavity 30 is formed between the external wall 14 and the twist support 16, the collector ring 26 being configured to discharge pressurised fluid, in this example gas, from this cavity 30.

The collector ring 26 is connected fluidically to the internal side CI of the inner wall 12 via air exhaust ducts 32. In this example, there are three air exhaust ducts 32 uniformly distributed around the axial direction X (i.e. the ducts 32 are spaced at 120° according to the circumferential direction C). Each duct 32 has an air outlet opening 32A arranged in the inner wall 12. As is seen in FIG. 4, in this example the outer wall 14 forms a section of the walls of each air exhaust duct 32.

The support 10 in this example has three tappings 34, 36 and 38 for fluidic connecting of the support 10 to an oil feed circuit of the bearing. In this example, the tappings 34, 36 and 38 are arranged on the inner side CI of the inner wall 12.

The tapping 34 is an oil feed tapping connected to an oil feed conduit 33 partly visible in FIG. 2, and terminating in the bearing support section 20 via the orifice 33A. In this example the conduit 33 is arranged in the thickness of the inner wall 12, and more particularly in this example of the first section 12A. The support 10 being formed by one and the same piece by manufacturing additive, the formation of this conduit 33 is facilitated and avoids complex machining necessary in the supports known from the prior art.

The tapping 36 is an oil recovery tapping connected to a collector 37 arranged between the outer wall 14, the inner wall 12 and the twist support 16. In this example, the collector 37 has a wall 37A extending radially between the twist support 16, in this example the sleeve 16A, the outer wall 14, and the inner wall 12. The collector 37 has an opening 37B arranged in the twist support 16, in this example the sleeve 16A Also, a through hole 23A is arranged vertically to the opening 37B, viewed according to the radial direction R.

The tapping 38 is an oil drainage tapping connected to an oil drainage duct 40. The oil drainage duct 40 extends on the external side of the outer wall 14 and has a first intake 42 arranged in the collector ring 26, a second intake 44 arranged in the outer wall 14 and opening in the space 30 formed between the twist support 16 and the outer wall 14. The tapping 38 forms the output of the conduit 40 which terminates to the internal side CI of the inner wall 12. As is seen in FIG. 4, the outer wall 14 and the inner wall 12 each form a section of the wall of the drainage duct 40.

In this example, the second intake 44 comprises two through holes 44A arranged in the outer wall 14, on either side according to the circumferential direction C of the collector 37, and adjacent to the collector 37 (see FIG. 5).

In this example, the drainage duct 40 defines the base B of the support 10, the top H being diametrically opposite. In this way, the support 10 is configured to be mounted inside the turbomachine 100, with the top H and the base B considered accordingly (i.e. the top above the base and inversely) according to the direction of gravity G, during normal operation of the turbomachine 100. The drainage of the oil occurs accordingly by gravity.

In this example, the drainage duct 40 is arranged diametrically opposite an air exhaust duct 32, and equidistant according to the circumferential direction C of the two other air exhaust ducts 32.

For example, with air circulating via the holes 23B which can possibly contain oil, this oil is drained by the drainage duct 40 via the second intake 44.

Even though the present invention has been described in reference to specific embodiments, it is evident that modifications and changes can be made to these examples without departing from the general scope of the invention such as defined by the claims. In particular, individual characteristics of the different embodiments as illustrated/mentioned can be combined into additional embodiments. Consequently, the description and the drawings must be considered in an illustrative rather than restrictive sense.

It is also evident that all characteristics described in reference to a process can be transposed, singly or in combination, to a device, and inversely all the characteristics described in reference to a device can be transposed, singly or in combination, to a process.

The invention claimed is:

1. A turbomachine output bearing support extending according to an axial direction, said support being formed by one and the same piece and comprising an annular inner wall and having an inner side and an outer side, an annular outer wall arranged to the outer side of the inner wall, and a twist support, the inner wall comprising a first section having a first substantially frustoconical form extending according to the axial direction and having the inner side and the outer side, the first section having a first axial end provided with a first attachment flange and a second axial end opposite according to the axial direction to the first axial end, provided with a bearing support section, the first section carrying on the inner side an inner section forming a second attachment flange, the twist support being carried by the inner wall on the outer side.

2. The turbomachine output bearing support according to claim 1, wherein the outer wall has a second substantially frustoconical form extending according to the axial direction and having a third axial end attached to the inner wall on the outer side of the inner wall, and a fourth axial end, opposite the second axial end according to the axial direction, forming a collector ring.

3. The turbomachine output bearing support according to claim 2, comprising at least one air exhaust duct extending on the external side of the outer wall and fluidically connecting the internal side of the inner wall and the collector ring.

4. The turbomachine output bearing support according to claim 3, comprising three air exhaust ducts uniformly distributed around the axial direction.

5. The turbomachine output bearing support according to claim 3, wherein the at least one air exhaust duct has an air outlet opening arranged in the inner wall.

6. The turbomachine output bearing support according to claim 1, comprising an oil drainage duct.

7. The turbomachine output bearing support according to claim 6, wherein the oil drainage duct extends on the external side of the outer wall and has a first intake arranged in the collector ring, a second intake arranged in the outer wall and opening into a space formed between the twist support and the outer wall, and an output terminating to the internal side of the inner wall.

8. A manufacturing process of a turbomachine output bearing support according to claim 1, comprising at least one additive manufacturing step.

* * * * *